United States Patent [19]

Heath

[11] 4,194,569

[45] Mar. 25, 1980

[54] FIRE EXTINGUISHERS

[75] Inventor: Richard C. Heath, 3, Barham Close, Weybridge, Surrey, England

[73] Assignee: Richard Charles Heath, Weybridge, England

[21] Appl. No.: 853,657

[22] Filed: Nov. 21, 1977

[30] Foreign Application Priority Data

Nov. 22, 1976 [GB] United Kingdom ..... 48658/76

[51] Int. Cl.[2] ..... A62C 35/02

[52] U.S. Cl. ..... 169/26

[58] Field of Search ..... 169/26–29

[56] References Cited

U.S. PATENT DOCUMENTS

| | | | |
|---|---|---|---|
| 2,016,668 | 10/1935 | Current et al. | 169/26 |
| 2,218,855 | 10/1940 | Roessner | 169/26 |
| 3,446,287 | 5/1969 | Hook | 169/28 |
| 3,447,609 | 6/1969 | Harvey | 169/28 X |
| 3,874,458 | 4/1975 | Williams | 169/28 X |

*Primary Examiner*—Robert W. Saifer

*Attorney, Agent, or Firm*—Albert C. Nolte, Jr.; Edward B. Hunter

[57] ABSTRACT

A fire extinguisher of the type comprising a burstable container adapted to provide a high mass flow rate of discharged extinguishant is provided with venting means so adapted to direct the flow of extinguishant from the container that the reaction forces upon the container during discharge of extinguishant compensate one another to reduce the resultant force upon the container.

1 Claim, 4 Drawing Figures

FIG. 3
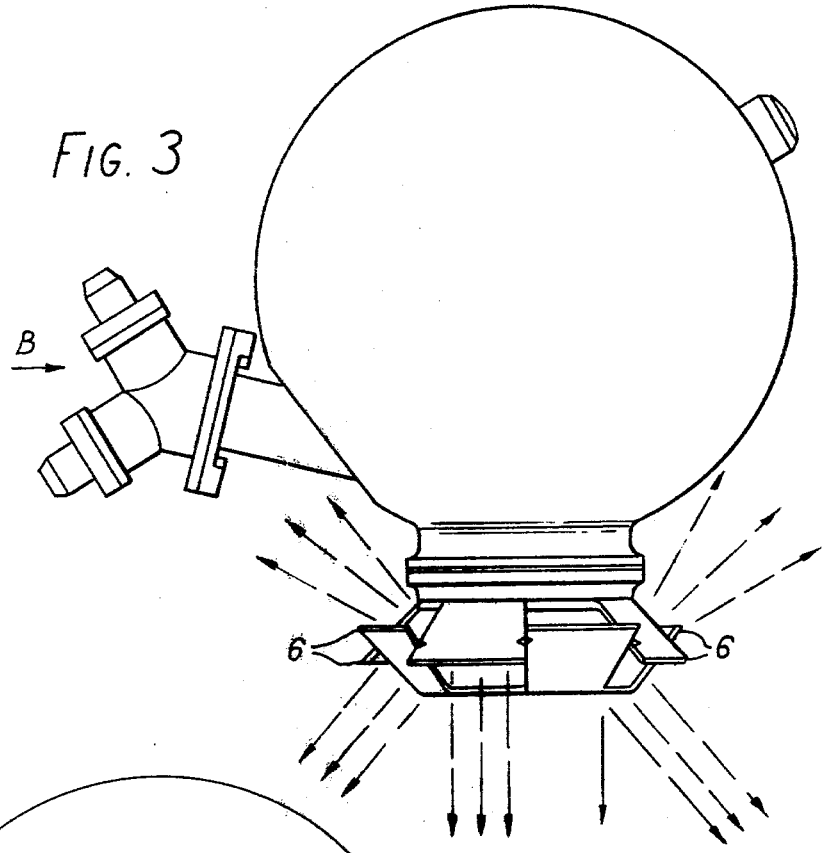
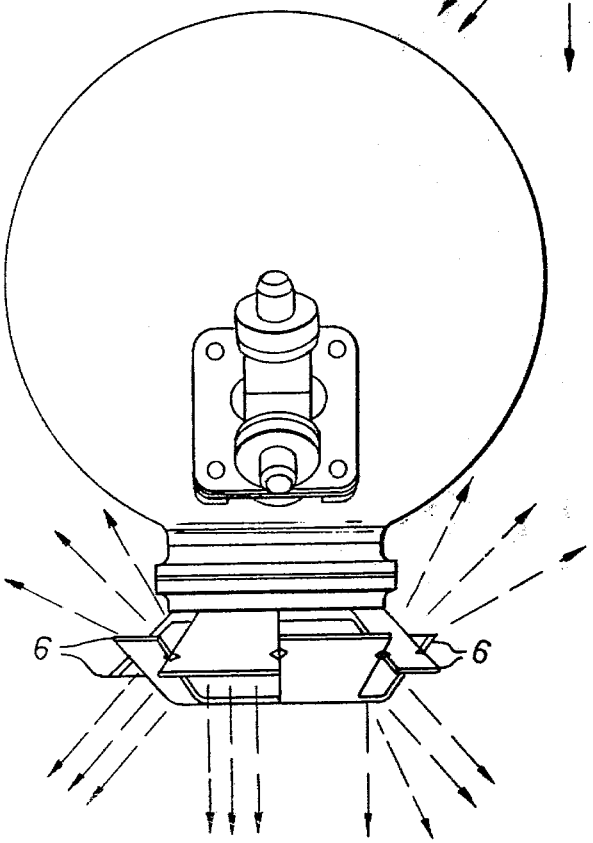
FIG. 4

FIRE EXTINGUISHERS

BACKGROUND OF THE INVENTION

In fire suppression systems requiring a high mass flow rate of extinguishant, for example in order to quench an incipient fire in the presence of a highly volatile liquid fuel, it is known to achieve the required rapid discharge of extinguishant from a container, by opening a relatively large bursting diaphragm fitted to a venting port of the container, thus permitting the contents to be ejected either by the vapour pressure of the extinguishant, or by the pressure derived from other means, for example an additional gas filling. Burstable containers of this kind have been proposed for use, for example, in aircraft fire suppression systems. However, such burstable containers have the disadvantage that the high mass flow rate of the fire extinguishant discharged therefrom can cause unduly high reaction forces to be imposed upon the container and thus upon the mountings by which it is secured in, for example, an aircraft, which reaction forces may possibly lead to failure of the mountings and damage to the adjacent structure of the aircraft.

SUMMARY OF THE INVENTION

It is an object of the present invention to eliminate, or at least to reduce, the above mentioned disadvantage of the known fire extinguishers referred to.

The present invention provides a fire extinguisher comprising a container providing a source of extinguishant, burstable means defining a part of said container and permitting, upon bursting thereof, a high mass flow rate of extinguishant from the container, and venting means defining a plurality of outlet ports through which extinguishant flowing from the burstable part of the container may be discharged, the number, size and position of the said discharge ports being balanced in such a manner that the reaction forces upon the container due to the flow of extinguishant from the discharge ports substantially balance one another. Thus the resultant force upon the container is reduced or eliminated.

According to one embodiment of the invention, the said venting means comprises a generally circular end cap overlying a circular burstable diaphragm closing said container, said end cap comprising an even number of radial outlet ports regularly angularly spaced around its periphery whereby each outlet port is balanced by a corresponding port diametrically opposed thereto.

According to a further, preferred feature of the invention the said outlet ports are associated with deflector plates for deflecting said extinguishant axially with respect to said circular end cap, the said deflector plates of alternate ports being angled in opposite directions, whereby the axial reaction forces due to discharge of extinguishant from alternate ones of said outlet ports are balanced by an oppositely acting axial force due to discharge of extinguishant from the remaining ports.

BRIEF DISCRIPTION OF THE DRAWINGS

The invention is illustrated by way of example in the accompanying drawings, in which:

FIG. 1 is a side elevation of a fire extinguisher in accordance with one embodiment of the present invention, FIG. 2 is a view in the direction of the arrow A of FIG. 1, FIG. 3 is a view similar to FIG. 1 of a further embodiment of extinguisher in accordance with the invention, and FIG. 4 is a view in the direction of the arrow B of FIG. 3.

DESCRIPTION OF THE PREFERRED EMBODIMENT

Figure 1:
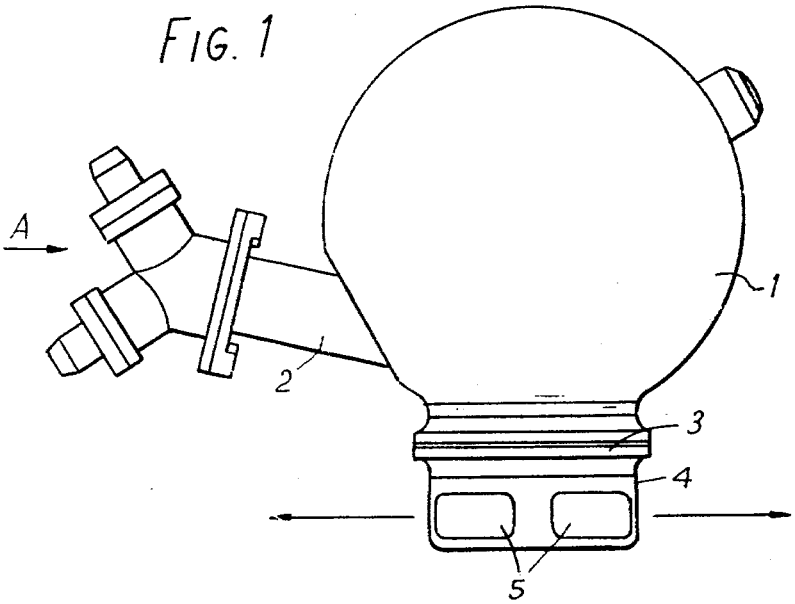
Figure 2:
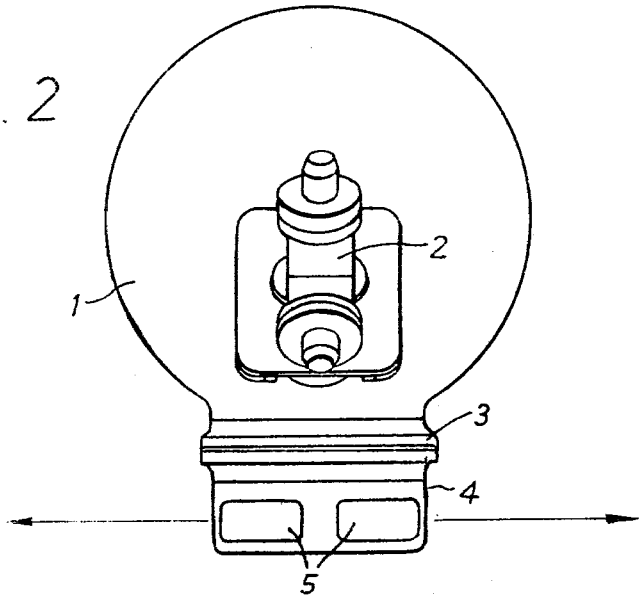

Referring to FIGS. 1 and 2 of the drawings, a fire extinguisher in accordance with one embodiment of the invention comprises a hollow bulb 1 defining a container for fire extinguishant. Attached to the bulb 1 are a union 2, providing for connection of the extinguisher into an electrical control circuit of known type not further illustrated, and a flange extinguishant discharge port 3 closed, in known manner, by means of a burstable diaphragm (not shown). The internal construction of the extinguisher is of generally known type, and therefore not illustrated or referred to in more detail. Briefly, however, upon receipt of an appropriate control signal via the union 2, the diaphragm closing the discharge port 3 is ruptured, for example by means of an explosive charge located within the bulb 1, to release the contents of the extinguisher.

The discharge port 3 is provided with an end cap 4, having lateral discharge orifices 5 for extinguishant. Thus in accordance with the invention, the end cap 4 provides for deflection of the fire extinguishant through the orifices 5. The discharge orifices 5 are regularly spaced around the periphery of the end cap 4, and thus a 360° radial dispersal of extinguishant is achieved, with substantially zero resultant reaction force being imposed upon the body of the extinguisher.

Although the discharge orifices 5 of the end cap 4 are as illustrated in FIGS. 1 and 2 of such relative proportions that a substantially radial 360° distribution of discharged extinguishant is obtained, it will be appreciated that by adjusting the arrangement and relative dimensions of the discharge orifices 5, the distribution pattern of the extinguishant can be modified in any desired manner. For example, by increasing the axial length of the orifices 5, a greater dispersion of extinguishant in the axial direction of the end cap 4 can be achieved. Also, as illustrated in FIGS. 3 and 4, auxiliary baffles 6 may be provided for deflection of the extinguishant in an axial direction.

I claim:

1. A fire extinguisher comprising a container providing a source of extinguishant, a circular burstable diaphragm closing said container and permitting, upon bursting thereof, a high mass flow rate of extinguishant from the container, and venting means comprising a generally circular end cap overlying said diaphragm, said end cap comprising an even number of radial outlet ports through which extinguishant flowing from the container is discharged, said outlet ports being regularly angularly spaced about its periphery whereby each outlet port is balanced by a corresponding port diametrically opposed thereto and wherein said outlet ports are associated with deflector plates for deflecting said extinguishant axial with respect to said circular end cap, the said deflector plate of alternate ports being angled in opposite directions, whereby the axial reaction forces due to discharge of extinguishant from alternate ones of said outlet ports balanced by an opposite reacting axial force due to discharge of extinguishant from the remaining ports.

* * * * *